US005421115A

United States Patent [19]

McKay

[11] Patent Number: 5,421,115

[45] Date of Patent: Jun. 6, 1995

[54] GUN REST

[76] Inventor: Leonard McKay, 3738 Spear St., Bethlehem, Pa. 18017

[21] Appl. No.: 236,104

[22] Filed: May 2, 1994

[51] Int. Cl.[6] ..... F41A 31/00

[52] U.S. Cl. ..... 42/94; 248/177; 248/163.1

[58] Field of Search ..... 42/94, 96; 89/37.03, 89/37.04; D16/244; 248/177, 163.1; 354/293

[56] References Cited

U.S. PATENT DOCUMENTS

D. 261,794 11/1981 Bechtel ..... D22/7
3,313,505 5/1965 Petrie ..... 248/165
3,703,046 11/1972 Barone et al. ..... 42/94
3,947,988 4/1976 Besaw ..... 42/94
3,964,613 6/1976 Anderson, Jr. ..... 211/64
4,397,112 8/1983 York ..... 42/94
4,558,532 12/1985 Wright ..... 42/94
5,060,410 10/1991 Mueller ..... 42/94

*Primary Examiner*—Charles T. Jordan
*Assistant Examiner*—Christopher Keith Montgomery

[57] ABSTRACT

A gun rest including a lightweight tripod having a V-shaped rest member engaging a gun disposed therein. The tripod folds or is easily disassembled for transport and is adjustable in height to accommodate various shooting styles and weapons.

9 Claims, 4 Drawing Sheets

GUN REST

BACKGROUND OF THE INVENTION

1. Field of the Invention

The present invention relates to gun rests and shooting aids and more particularly pertains to a gun rest which may be employed to steady a firearm principally when conducting firing at a target range.

2. Description of the Prior Art

The use of gun rests is known in the prior art. More specifically, gun rests heretofore devised and utilized for aiding in maintaining the aim of a firearm are known to consist basically of familiar, expected and obvious structural configurations, notwithstanding the myriad of designs encompassed by the crowded prior art which have been developed for the fulfillment of countless objectives and requirements.

The present invention is directed to improving devices for a gun rest in a manner which is safe, secure, economical and aesthetically pleasing.

For example, U.S. Pat. No. 5,060,410 to Mueller discloses a collapsible shooting stand comprising a collapsible seating assembly having a V-shaped firearm support included therein. The Mueller invention does not employ tripodal support techniques, is not removably installed upon a tabletop or bench, and is not easily portable. The present invention excludes a seat and is readily transported in a small package held by a single hand. The present invention is set up upon a tabletop or shooting bench and may be removed and packaged for transport within a minute duration.

In U.S. Pat. No. 3,964,613 to Anderson, Jr. a rifle support is disclosed comprising a portable rifle rest having a barrel support and a stock support and an optional storage compartment. The purpose of the Anderson Jr. invention is to hold a rifle for cleaning and disassembly and is not generally employable as a rest for shooting. The present invention comprises a gun rest for the purpose of shooting and therefor differs in manner of holding the weapon to achieve consistent accuracy therewith.

In U.S. Pat. No. 4,397,112 to York a rifle bipod is described. The York invention comprises a pivotably connected leg pair which grips a rifle barrel under the action of spring force and thereby steadies the weapon for shooting. The present invention provides substantial additional support in being a tripod supported rest, and furthermore the present invention has a substantial range of elevation adjustment thereby accommodating a wide variety of shooting styles and weapons.

In U.S. Pat. No. 4,558,532 to Wright a rifle benchrest is disclosed for improving accuracy in firing rifles. The Wright invention comprises a padded base and support post pair which are employed to steady a rifle or pistol when shooting. A disadvantage in this prior art lies in a lack of adjustability of the height of the barrel rest portion and a lack of provision for folding or other transport advantages. The present invention comprises an adjustable height barrel rest and furthermore may be folded or disassembled and carried in a small package rendering it useful in carriage by hand to the most primitive shooting areas where accuracy enhancement is desired.

U.S. Pat. No. D. 261,794 to Bechtel discloses the ornamental design for a rifle pedestal for shooting ranges and the like. The disclosure teaches a heavy duty gun rest base having an adjustable height central rest pedestal and three adjustable feet disposed in a single plane about a substantially circular plate affixed to the pedestal. The feet adjustment means comprises locking setscrews which provide a leveling or fine adjustment capability. The disclosure makes no provision for a lightweight tripodal support arrangement and, although three coplanar feet are employed, has no tripodal support arrangement. Furthermore, the Bechtel invention has no gun support member included upon the central rest pedestal. The present invention employs the advantage of a tripodal support arrangement whereby rest stability is achieved in a lightweight assembly having a gun support rest disposed upon an adjustment member supported from a common joint of the three leg members comprising the tripod.

In this respect, the gun rest according to the present invention substantially departs from the conventional concepts and designs of the prior art, and in so doing provides an apparatus primarily developed for the purpose of resting various firearms thereupon during shooting to aid in maintaining accuracy.

Therefore, it can be appreciated that there exists a continuing need for a new and improved gun rest which can be easily transported to any shooting site and be setup in a short time thereafter. In this regard, the present invention substantially fulfills this need.

As illustrated by the background art, efforts are continuously being made in an attempt to improve gun rests and related shooting aids. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of gun rest now present in the prior art, the present invention provides an improved gun rest construction wherein the same can be utilized for steadying a firearm for improving aim when shooting. As such, the general purpose of the present invention, which will be described subsequently in greater detail, is to provide a new and improved gun rest apparatus and method which has all the advantages of the prior art gun rests and none of the disadvantages.

The invention is defined by the appended claims with the specific embodiment shown in the attached drawings. For the purpose of summarizing the invention, the invention may be incorporated into a tripodal disposition of lightweight leg members wherein the three leg members are joined at one end and engage a plane surface at the opposing end there being a significant and substantial separation between the leg members at the plane surface. The place of joining of the leg members has an elongated threadedly adjustable locking rod member passed therethrough wherein a V-shaped gun engaging member is disposed at one end of the rod member the gun engaging member being maintained a most remote from the plane surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved gun rest of lightweight and portable construction.

It is therefore an additional object of the present invention to provide a new and improved gun rest which has all the advantages of the prior art gun rests and none of the disadvantages.

It is another object of the present invention to provide a new and improved gun rest which may be easily and efficiently manufactured and marketed.

It is a further object of the present invention to provide a new and improved gun rest which is of a durable and reliable construction.

An even further object of the present invention is to provide a new and improved gun rest which is susceptible of a low cost of manufacture with regard to both materials and labor, and which accordingly is then susceptible of low prices of sale to the consuming public, thereby making such gun rests economically available to the buying public.

Still yet another object of the present invention is to provide a new and improved gun rest which provides in the apparatuses and methods of the prior art some of the advantages thereof, while simultaneously overcoming some of the disadvantages normally associated therewith.

Still another object of the present invention is to provide a new and improved gun rest having an adjustable rest height.

Yet another object of the present invention is to provide a new and improved gun rest employing a tripodal support technique.

Even still another object of the present invention is to provide a new and improved gun rest capable of rapid disassemble and hand portability.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
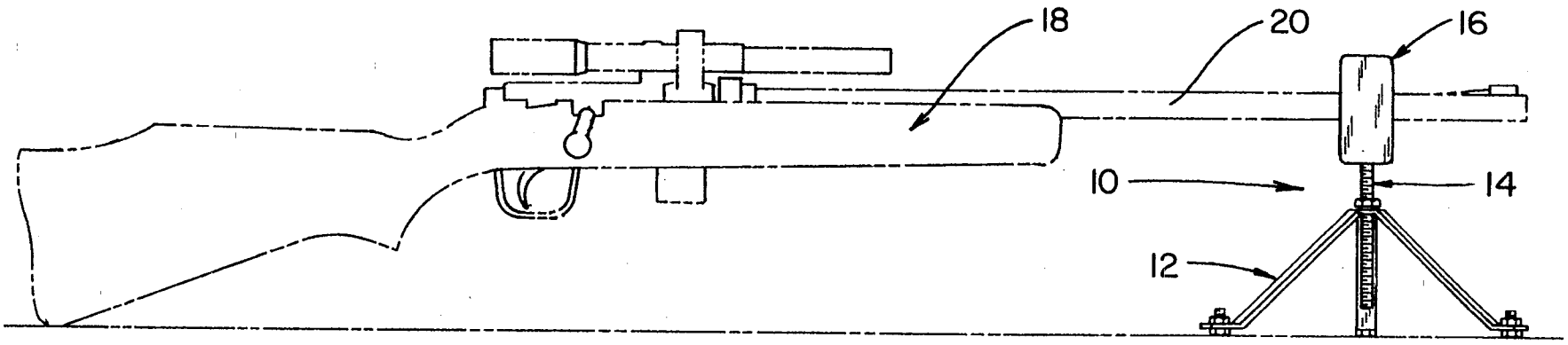
FIG. 1 is a side elevational view of the gun rest showing the rest and a rifle supported therein.

With reference now to the drawings, and in particular to FIG. 1 thereof, a new and improved gun rest embodying the principles and concepts of the present invention and generally designated by the reference numeral 10 will be described.

From an overview standpoint, the gun rest 10 is adapted for use with a firearm to maintain stability during shooting thereby improving accuracy. The gun rest 10 comprises a tripodal support 12, a locking threaded rod member 14, and a V-shaped gun support member 16. See FIG. 1. Firearm 18 is positioned to aim toward the intended bullet impact site and gun rest 10 is positioned beneath a barrel 20 or forward stock portion to provide steadying support.

Figure 2:
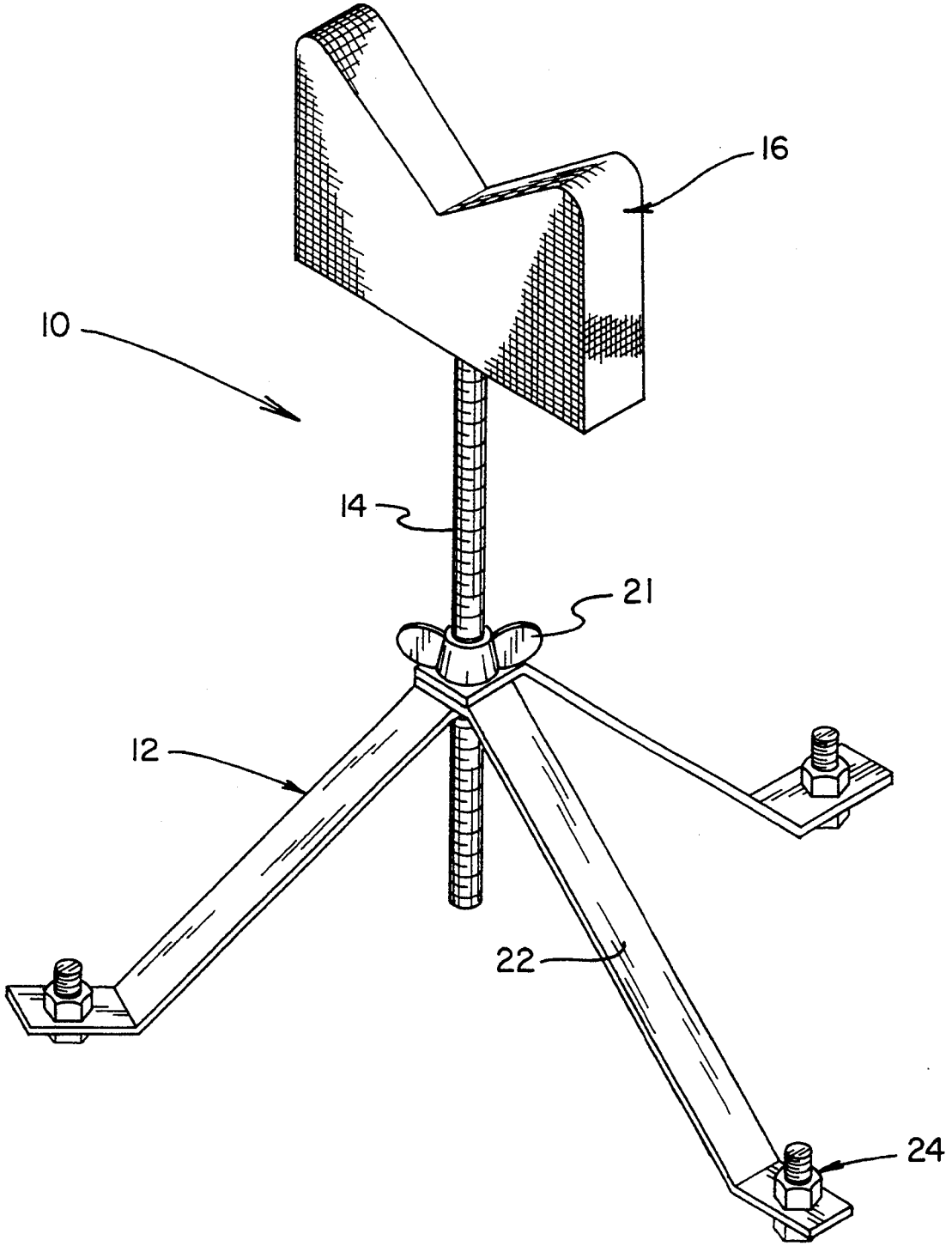
FIG. 2 is a perspective view of the gun rest in a partially elevated position.
Figure 3:
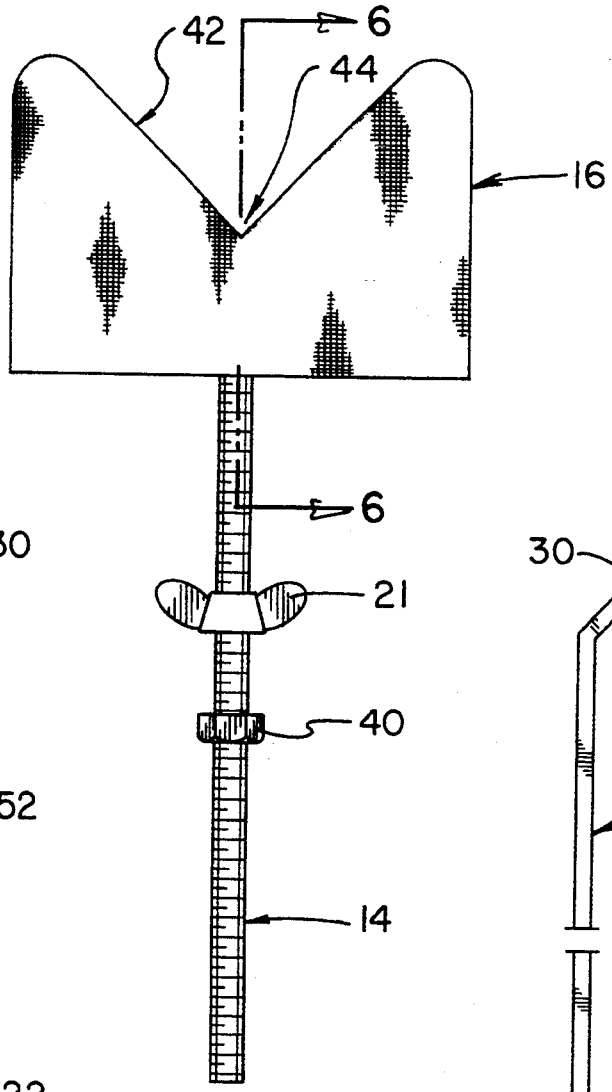
FIG. 3 is side elevational view of the gun rest showing the V-shaped support and threaded adjustment rod.
Figure 4:
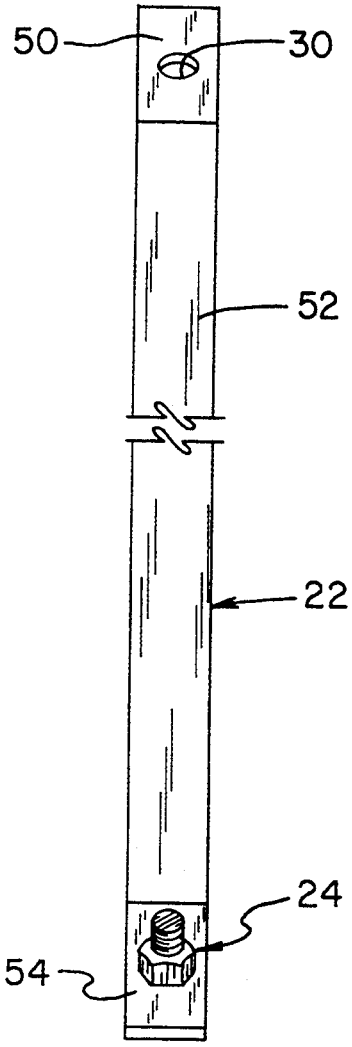
FIG. 4 is a fragmentary top elevational view of the gun rest showing a leg member.

More specifically, it will be noted that the gun rest 10 comprises a tripodal support 12 joined at a common through hole wherein a threaded rod member 14 is disposed and further locked in position by locking member 21, and furthermore a V-shaped gun support member 16 terminates an end of threaded rod 14. See FIG. 2. Tripodal support 12 comprises three substantially identical leg members 22 of substantially identical form having foot members 24 disposed at one end thereof. In use, leg members 22 are evenly angularly disposed to form a symmetric tripod. See FIGS. 3 and 4. Threaded rod member 14 engages through hole 30 of leg members 22 and passes therethrough thereby providing pivotal joining unless locking member 20 is tightened. Locking member 20 comprises a wing nut threaded fastener acting cooperatively with a second threaded fastener 40 to lock the leg members 22 in position and to maintain a selected height of gun support member 16. In setup, leg members 22 are disposed on threaded rod member 14 between locking member 20 and second nut 40. Second nut 40 is positioned on threaded rod 14 to place gun support member 16 at a suitable height. Locking member 20 is subsequently tightened thereby rigidly joining the three leg members and the threaded rod member at a single location.

Figure 5:
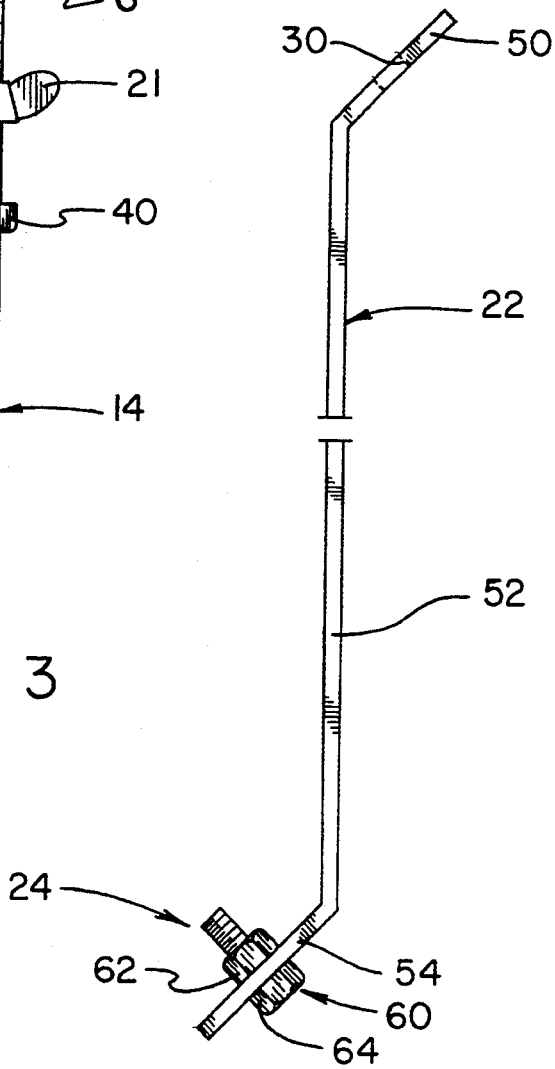
FIG. 5 is a fragmentary side elevational view of a gun rest showing a leg member.
Figure 6:
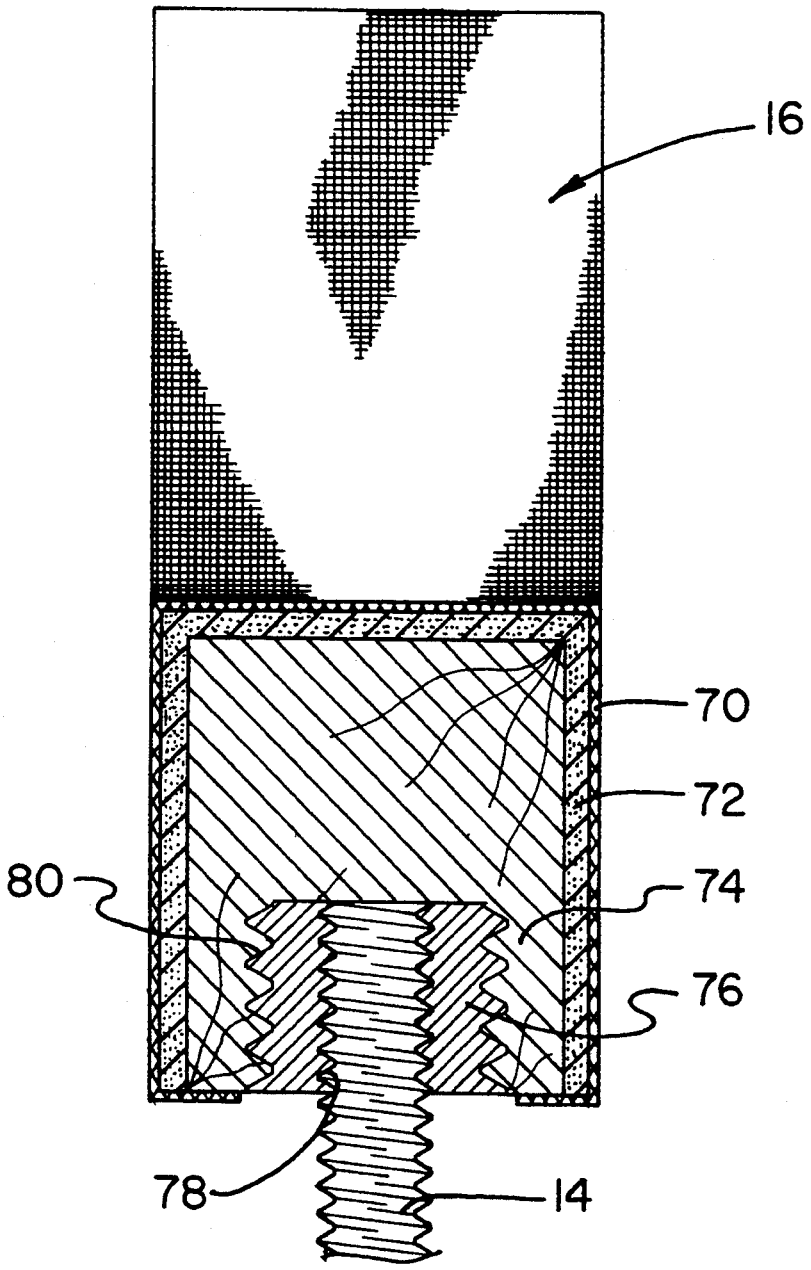
FIG. 6 is a fragmentary side sectional view of the gun rest taken substantially upon the plane indicated by the section line 6—6 of FIG. 3.

Leg member 22 comprises an elongated substantially flattened bar having a first end portion 50, a central portion 52, and a second end portion 54. First end portion 50 has through hole 30 disposed therein and angularly intersects central portion 52. See FIG. 5. The angle of intersection of first end portion 50, which lies substantially in a true horizontal plane when operationally disposed, and central portion 52 establishes the spacing of leg members 22 when the gun rest 10 is in use by triangular geometrical considerations. Second end portion 54 lies in a plane substantially parallel to a plane containing first end portion 50.

Second end portion 54 is perforated by a through hole having a foot member 24 affixed therein using threaded fastening methods. The height of a gun disposed upon the gun rest 10 is the combined distance between the planes of first and second end portions 50 and 54, and the spacing of the gun at rest and first end portion 50. Stability of the gun rest 10 is provided by rigidity of the materials employed in construction therein and in judicious selection of the angular disposition of first end portion 50 and central portion 52, and the length of central portion 52. Leg member 22 may have a longitudinal rib or indented portion disposed thereon to provide added strength and to maintain a lightweight configuration.

Foot member 24 comprises a bolt 60 threadedly engaging nut 62. The head 64 of bolt 60 may have a nonskid pad affixed thereon or be substantially pointed in shape thereby providing superior engagement of surfaces upon which the gun rest 10 is disposed. And furthermore, nut 62 may be affixed to leg member 22 wherein bolt 60 may be employed to provide an adjustment substantially equivalent to lengthening a leg member 22.

V-shaped gun support member 16 comprises a thickened flat plate having a V-shaped notch 42 disposed through a minor dimension and furthermore the apex of said V-shaped notch 42 is disposed in lateral alignment with the center of threaded rod member 14 thereby providing the V-shaped notch 42 an inverted central disposition upon the threaded rod member 14. The V-shaped notch opens to form a centrally disposed gun engagement portion 44 wherein the barrel or forward stock portion of a gun may be placed during shooting. V-shaped gun support member 16 may have an outer covering 70 comprising polymeric film or fabriclike materials. Outer covering 70 may have various ornamental designs imprinted or wovenly introduced thereon including a popular camouflage pattern. Padding 72 may be disposed between a core member 74 and the outer covering 70. Core member 74 may be of wooden, metallic, or polymeric composition.

Threaded rod 14 threadedly engages threaded bushing 76 to enhance stability when wooden or soft plastic core members 74 are employed. Threaded bushing 76 has an internally threaded hole 78 axially disposed therein which securely engages threaded rod 14. And furthermore, threaded bushing 76 has an externally threaded portion 80 matingly engaging an internal thread disposed within a substantially cylindrical cavity formed within core member 74.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A new and improved gun rest for providing support for a firearm during shooting comprising:

a firearm support member upon which a portion of a firearm may be engaged, three leg members wherein each leg member comprises a first end portion having a through hole disposed therein, an elongated central portion being angularly disposed to said first end portion, and a second end portion being angularly disposed to said central portion, a rod member threadedly engaging the firearm support member at one end and penetrating the through holes in the first end portion of said leg members wherein said through holes are substantially axially aligned and said central portions of said leg members are substantially evenly separated and lying substantially within a cone having an apex disposed substantially on the axis of the rod between a first end portion through hole and a rod end engaging the firearm support member, and a threadedly engaging locking means adjustably affixing the leg members to the rod member.

2. The new and improved gun rest of claim 1 in which said firearm support member comprises a rectangular solid having a substantially V-shaped notch disposed therein and a threaded receiving cavity disposed in opposition to the apex of said V-shaped notch.

3. The new and improved gun rest of claim 2 in which said firearm support member is at least partially covered by a first inner layer and a second outermost layer wherein the first inner layer comprises a soft foamlike material and the second outermost layer comprises a thin fabriclike covering which may have various decorative patterns disposed thereon.

4. The new and improved gun rest of claim 3 in which said firearm support member is of wooden construction.

5. The new and improved gun rest of claim 1 in which said leg members comprise substantially flattened bar members having the first end portion and the second end portion lying substantially in two planes having a parallel disposition.

6. The new and improved gun rest of claim 1 in which said second end portion of each leg member has a through hole disposed therein.

7. The new and improved gun rest of claim 6 in which said through hole in the second end portion has a foot member disposed therethrough, and furthermore said foot member comprises a bolt-like first member and a nut-like second member threadedly engaging said boltlike member.

8. The new and improved gun rest of claim 7 in which said boltlike first member has a threaded portion and a head portion wherein the head portion forms an end thereof having a frictionally engaging member attached thereon.

9. The new and improved gun rest of claim 1 in which said threadedly engaging locking means comprises a first nut member and a second wing nut member threadedly engaging the rod member and furthermore having the three first end portions of the leg members disposed therebetween.

* * * * *